US007887029B2

(12) United States Patent
Flannery

(10) Patent No.: US 7,887,029 B2
(45) Date of Patent: Feb. 15, 2011

(54) IN-HOUSE GATED SAFETY BARRIER HAVING CUSTOMIZABLE LAYOUT

(75) Inventor: Mark A Flannery, Lakeville, MN (US)

(73) Assignee: Carlson Pet Products, Inc., Prior Lake, MN (US)

( * ) Notice: Subject to any disclaimer, the term of this patent is extended or adjusted under 35 U.S.C. 154(b) by 201 days.

(21) Appl. No.: 11/709,961

(22) Filed: Feb. 23, 2007

(65) Prior Publication Data

US 2008/0185566 A1 Aug. 7, 2008

Related U.S. Application Data

(60) Provisional application No. 60/899,819, filed on Feb. 5, 2007.

(51) Int. Cl.
*E04H 17/16* (2006.01)

(52) U.S. Cl. ..... 256/73; 256/65.16; 256/67; 49/56

(58) Field of Classification Search ..... 256/1, 256/65.01, 65.15, 67, 73, 65.04; 403/52, 403/64, 63, 83, 84, 94, 96, 101; 49/384, 49/50, 56, 57, 397
See application file for complete search history.

(56) References Cited

U.S. PATENT DOCUMENTS

| | | | | | |
|---|---|---|---|---|---|
| 309,039 | A * | 12/1884 | Foster | 16/316 |
| 2,810,554 | A * | 10/1957 | Blazey | 256/25 |
| 3,092,407 | A * | 6/1963 | Blonder | 403/191 |
| 3,222,509 | A * | 12/1965 | Thedford | 362/152 |
| 4,702,036 | A * | 10/1987 | Johnson | 49/55 |
| 4,787,174 | A * | 11/1988 | Brown | 49/55 |
| 4,982,933 | A * | 1/1991 | Schultz | 256/65.06 |
| 5,039,118 | A * | 8/1991 | Huang | 280/47.371 |
| 5,228,535 | A * | 7/1993 | McCarty | 182/163 |
| 5,282,606 | A * | 2/1994 | Praiss | 256/26 |
| 5,527,016 | A * | 6/1996 | Wilkerson, Jr. | 256/67 |
| 5,615,968 | A * | 4/1997 | Verenski et al. | 403/312 |
| 5,661,942 | A * | 9/1997 | Palmer | 52/653.2 |
| 5,664,769 | A * | 9/1997 | Sadinsky et al. | 256/73 |
| 5,782,282 | A * | 7/1998 | Chen | 160/206 |
| 5,966,777 | A * | 10/1999 | Jantschek | 16/354 |
| 6,068,358 | A * | 5/2000 | Rieger | 312/329 |
| 6,123,321 | A * | 9/2000 | Miller | 256/25 |
| 6,595,498 | B1 * | 7/2003 | Andersen | 256/67 |
| 6,715,182 | B2 * | 4/2004 | Cheng | 16/280 |
| 7,216,854 | B2 * | 5/2007 | Bryan | 256/25 |
| 7,318,298 | B2 * | 1/2008 | Marsden et al. | 49/57 |
| 7,540,046 | B1 * | 6/2009 | Lai | 5/100 |

* cited by examiner

*Primary Examiner*—Daniel P Stodola
*Assistant Examiner*—Nahid Amiri

(57) ABSTRACT

A safety barrier for an inside of a house for partitioning off a portion of the house. The safety barrier includes a number of individual barrier sections where two adjacent barrier sections are engaged via a connector. The connector has an upper connection, a lower connection, and an elongate central member interconnecting the upper and lower connections. Each of the connections has a pair of relatively swingable arms. Each of the arms engages a barrier section. A threaded member draws the upper and lower connections closed simultaneously to fix the arms relative to each other and to thus fix the barrier sections relative to each other. The arms, prior to being fixed, are swingable relative to each other from about zero degrees to about 270 degrees such that a zig-zag, linear, or circular barriers can be made. A gate or door that can be opened and closed for access to the partitioned section of the house is engaged in one of the barrier sections.

6 Claims, 5 Drawing Sheets

IN-HOUSE GATED SAFETY BARRIER HAVING CUSTOMIZABLE LAYOUT

This application claims the benefit of U.S. Provisional Patent Application No. 60/899,819 filed Feb. 5, 2007 under 35 U.S.C. §119(e).

FIELD OF THE INVENTION

The present invention relates generally to a fence-like partition for an inside of a house, more particularly to such a partition having a gate, and specifically to an in-house gated partition or safety barrier having individual partition or barrier sections that can be fixed at multiple angles relative to each other so as to customize a layout of the partition.

BACKGROUND OF THE INVENTION

A safety gate for a residence is usually merely a gate with extensions that slide out to opposing walls. For example, the safety gate may be placed at the foot or top of a staircase, or at the access to the kitchen, or somewhere else in the house where access to a room is sought to be denied to a small child or pet. Such a conventional safety gate presumes that many homes are the same, that door frames and hallways are of a certain standard width, and that only narrow passages are sought to be fenced off.

SUMMARY OF THE INVENTION

A feature of the present invention is the provision in a set of barrier sections, of a connector engaging adjacent barrier sections and having upper and lower connections that engage the barrier sections, where each of the upper and lower connections includes a pair of arms that swing relative to each other such that the barrier sections can be set at multiple angles relative to each other, and where the connector tightens and loosens the upper and lower connections simultaneously.

Another feature of the present invention is the provision in a set of barrier sections, of a connector engaging adjacent barrier sections and having upper and lower connections that engage the barrier sections, where each of the upper and lower connections includes a pair of arms that swing relative to each other such that the barrier sections can be set at multiple angles relative to each other, and where each of the upper and lower connections includes a pair of jaws that open to permit swinging of the arms and barrier sections and that close to fix in place the arms and barrier sections.

Another feature of the present invention is the provision in a set of barrier sections, of a connector engaging adjacent barrier sections and having upper and lower connections that engage the barrier sections, where each of the upper and lower connections includes a pair of arms that swing relative to each other such that the barrier sections can be set at multiple angles relative to each other, and where the connector includes an elongate central member between the upper and lower connections to draw at least one of the upper and lower connections open and closed along an axis of the elongate central member.

Another feature of the present invention is the provision in a set of barrier sections, of a connector engaging adjacent barrier sections and having upper and lower connections that engage the barrier sections, where each of the upper and lower connections includes a pair of arms that swing relative to each other such that the barrier sections can be set at multiple angles relative to each other, and where one of the barrier sections includes a gate that can be opened and closed.

Another feature of the present invention is the provision in a set of barrier sections, of a connector engaging adjacent barrier sections and having upper and lower connections that engage the barrier sections, where each of the upper and lower connections includes a pair of arms that swing relative to each other such that the barrier sections can be set at multiple angles relative to each other, including about zero degrees relative to each other, and including 270 degrees relative to each other.

Another feature of the present invention is the provision in a set of barrier sections, of a connector engaging adjacent barrier sections and having upper and lower connections that engage the barrier sections, where each of the upper and lower connections includes a pair of arms that swing relative to each other, and where connectors that swing to zero degrees in one direction are staggered with connectors that swing zero degrees in the other direction such that the barrier sections can fold down into a generally flat Z-type arrangement An advantage of the present invention is that the present gated safety barrier may take a zig-zag, linear or generally circular or pentagon like form when the barrier extends from one wall to another wall.

Another advantage of the present invention is that the present gated safety barrier is, after being set up, flexible in the sense that the one barrier section articulates relative to another barrier section without taking down any portion or section of the gated safety barrier, such that a zig-zag arrangement may be transformed into a linear arrangement or circular arrangement or an arrangement of another shape.

Another advantage of the present invention is that the present barrier may extend out into a room from one portion of a wall and then extend back to another portion of the wall, thus forming a partitioned space along a wall. Such a partitioned space may take a circular or square or rectangular form or pentagon like form or another type of form.

Another advantage of the present invention is that adjacent barrier sections can be relatively tightened or loosened relative to each other by simply turning a knob. The knob includes a threaded member that tightens and loosens an upper connection and a lower connection at the same time.

Another advantage of the present invention is that the present gated safety barrier is lightweight and sturdy.

Another advantage of the present invention is that the present gated safety barrier is inexpensive to manufacture.

Another advantage of the present invention is that the present safety barrier can be set up and taken down easily, simply and quickly.

DESCRIPTION

Figure 1:
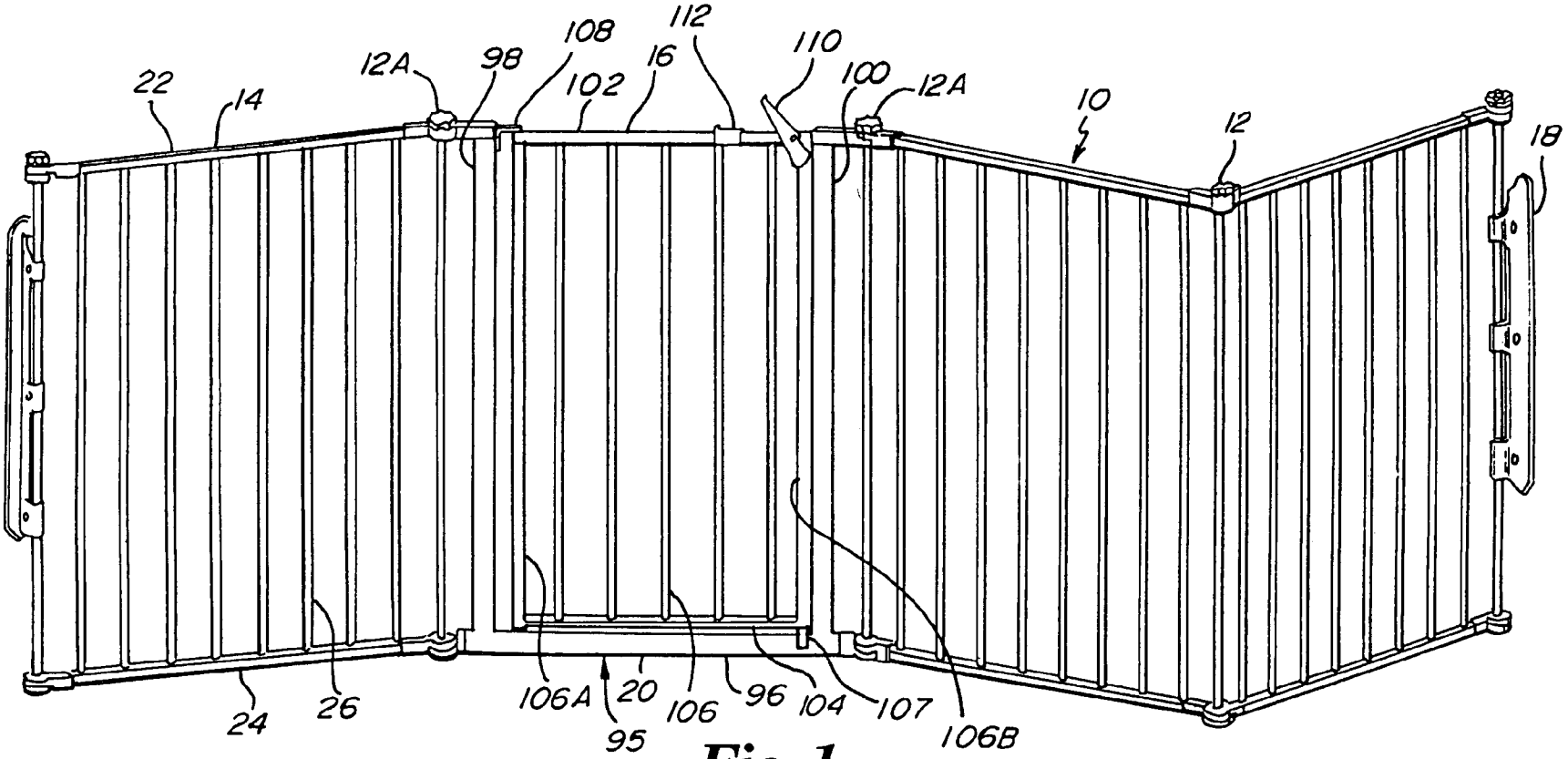
FIG. 1 is a perspective view of the present in-house gated safety barrier with customizable layout.

As shown in FIG. 1, the present safety barrier or partition is indicated in general by the reference number 10. The safety barrier 10 generally includes a connector 12, barrier sections 14, a gate 16 in a barrier section, and a pair of bases 18 for engaging end barrier sections 14 to a vertically running surface such as a wall. The connector 12 is engaged between two adjacent barrier sections 14 and is also utilized to engage an end barrier section 14 to a wall.

As shown in FIG. 1, barrier section 14 is a nongated barrier section. A gated barrier section is indicated by reference number 20.

As shown in FIG. 1, barrier section 14 includes an upper lateral or horizontal member 22, a lower lateral or horizontal member 24 running parallel to the upper lateral member 22, and a set of longitudinal or vertical elongate members 26 engaged between the upper and lower lateral members 22, 24. Each of the longitudinal elongate members 26 run parallel to each of the other longitudinal elongate members 26. Ends of the upper and lower lateral members 22, 24 run beyond end longitudinal elongate members 26 to provide a male member that engages a female member of an arm of connector 12. In other words, each of the end longitudinal elongate members 26 is offset from the ends of the upper and lower lateral members 22, 24. The longitudinal elongate members 26 are spaced from each other by a sufficiently short distance to maximize safety. For example, the distance between two adjacent longitudinal elongate members 26 is sufficiently small to prevent a small child or infant from inserting his or her head between two adjacent longitudinal members 26. The longitudinal elongate members 26 are spaced from each other by a sufficiently great distance to prevent the safety barrier 10 from weighing too much and causing harm if, for instance, an unattended and unengaged barrier section 14 fell to the floor.

Figure 4:
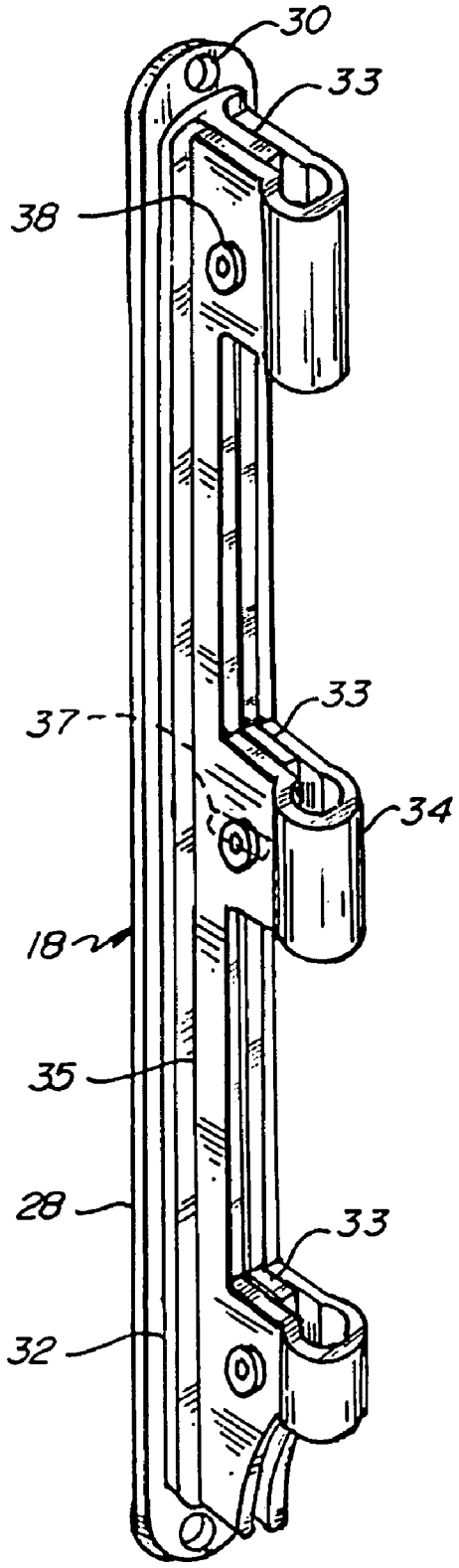
FIG. 4 is a perspective, detail view of a base utilized for engagement of the barrier section to a wall.

As shown in FIG. 4, a base 18 is provided to engage the end barrier sections 14 to a vertically running surface such as a wall. Base 18 includes a flat elongate member 28 with upper and lower pin connector holes 30 such that the flat elongate member 28 may be engaged to a wall, or to the studs behind a wall, with screws or other pin connectors. The holes 30 may also or alternatively be formed behind T-shaped member 32 such that the holes 30 and their pin connectors may be hidden from view. T-shaped member 32 is fixed to the flat elongate member 28 via a keyhole type arrangement where member 28 includes keyholes and where member 32 includes cooperating keys or pins where the key or pin has a head that drops into one relatively wide portion of the keyhole and that then is slid to a second relatively narrow portion of the keyhole where the second portion of the keyhole is sized to prevent the direct withdrawal of the key or head such that T-shaped member 32 is removably engageable to the member 28. Member 32 is T-shaped in section so as to have wings 33 that engage a hinge member 35 adjacent to respective hinges 34 of the hinge member 35. Each of the wings 33 has an elongate laterally extending slot 37, shown in phantom, that is aligned with a pin connector hole formed in hinge member 35, and each of the aligned slots 37 and pin connector holes receives a pin connector 38. A tightening and loosening of pin connectors 38 tightens and loosens the hinge member 35 relative to the wings 33 of the T-shaped member 32 and thus permits lateral adjustment of the T-shaped member 32 relative to the hinge member 35 via the elongate slot 37 traveling laterally relative to the pin connector 38. Thus, via base 18, the barrier sections 14 as a whole can be adjusted laterally relative to a wall (to and away from a wall in the horizontal direction). A tightening and loosening of the pin connector 38 may also decrease the inner diameters of the hinges 34 such that pivoting of the elongate central member 36 may or may not be permitted relative to the hinges 34. Preferably base 18 is constructed such that pivoting of the member 36 relative to the hinges 34 is permitted when pin connectors 38 are in a tightened configuration. To install the base 18 relative to the connector 12, hinge member 35, which has two side portions joined by the hinges 34, is slid laterally onto the elongate central member 36. Then the hinge member 35 is fixed to the wings 33 of the T-shaped member 32 via the pin connectors 38.

Figure 2A:
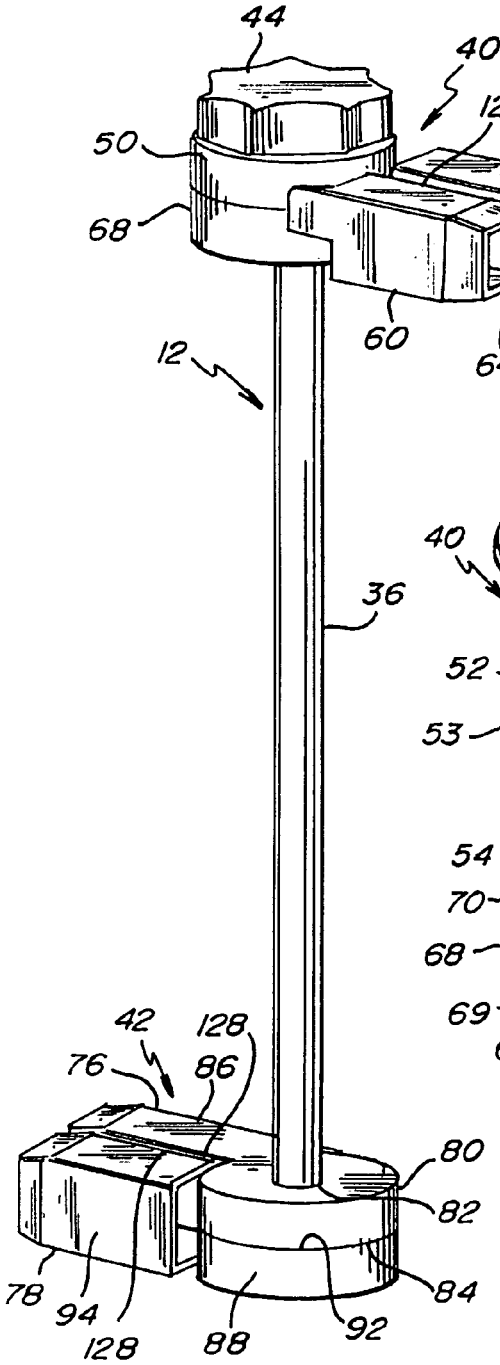
FIG. 2A is a perspective, detail view of the connector of FIG. 1, where the connector includes an upper connection and a lower connection and where each of the connections includes first and second arms.
Figure 2B:
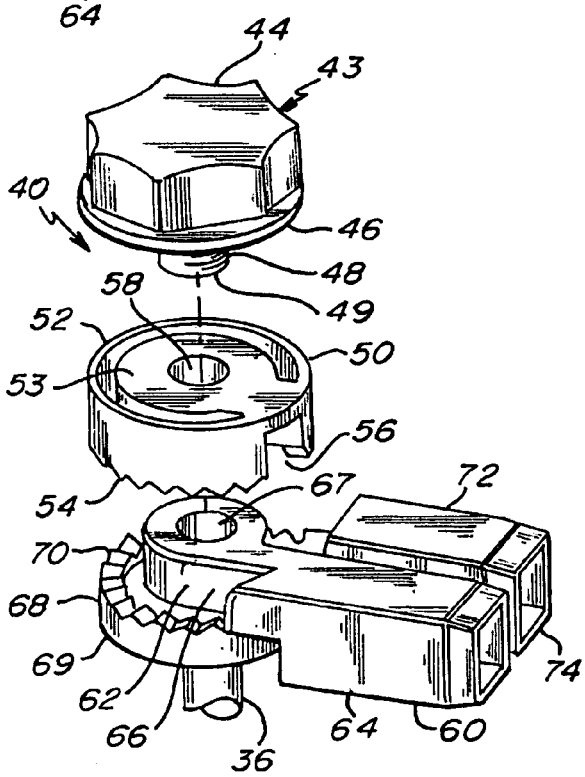
FIG. 2B is a perspective, detail and broken apart view of the upper connection of the connector of FIG. 2A.

As shown in FIGS. 2A and 2B, connector 12 includes an upper connection 40 and a lower connection 42 that are interconnected by the elongate central member 36. Upper connection 40 includes a threaded member 43 that includes a knob 44 having a lower annular rim 46 and a threaded shaft 48. Threaded shaft 48 includes a distal end 49 that, as further explained below, pushes downwardly upon the upper end of elongate central member 36. Knob 44, annular rim 46, and threaded shaft 48 are integral and one-piece with each other such that when the knob 44 is turned, the threaded shaft 48 also turns. Knob 44, annular rim 46, and threaded shaft 48 are aligned axially with the elongate central member 36. The knob 44 and rim 46 are formed of a plastic. Threaded shaft 48 is preferably formed of a metal material as the shaft 48 interacts with the central elongate member 36, which is also preferably formed of a metal material.

Upper connection 40 further includes an upper jaw 50. Upper jaw 50 is cylindrical in shape and includes an upper annular rim 52 and inner annular surface 53. Upper annular rim 52 confronts and slides against the lower surface of knob annular rim 46. Opposite the upper annular rim 52, the upper jaw 50 includes a substantially annular set of teeth 54 interrupted from being perfectly annular by a slot 56 that extends in an axial or longitudinal direction from the teeth 54 toward the annular rim 52. The number of teeth 54 may range from about 15 to about 40, with about 20 to 25 teeth being preferred. Upper jaw 50 further includes a central axial nonthreaded opening 58 for receiving the threaded shaft 48. The outside diameter of the upper jaw 52 is the same as the outside diameter of the knob annular rim 46.

Upper connection 40 still further includes a first upper arm 60 having a central axis portion 62, a female receptor portion 64 and a medial section 66 that is received in the slot 56 so as to engage upper arm 60 to jaw 50 but permit relative vertical movement therebetween. Axis portion 62 includes a central nonthreaded opening 67 for reception of threaded shaft 48 such that first upper arm 60 is swingable relative to the central elongate member 36. Female receptor portion 64 receives and engages an outer end of upper lateral member 22. First upper arm 60 is engaged to the first upper jaw 50 via slot 56 and via axis portion 62 which is received in the upper jaw 52. Upper arm 60 and upper jaw 50 pivot in unison about threaded shaft 48. When threaded shaft 48 is tightened or loosened, upper jaw 50 slides vertically relative to upper arm 60. Axis portion 62 rotationally engages cylindrical portion 71 of jaw 68, which is described below.

Upper connection 40 yet further includes lower jaw 68. Lower jaw 68 includes an axis portion 69 that is cylindrical in shape and has an upwardly extending set of annular teeth 70 for engaging and meshing with downwardly protruding teeth 54. Lower jaw 68 may include between about 15 and about 40 teeth 70, more preferably between about 20 and about 30 teeth 70. Axis portion 69 includes a central cylindrical portion 71 (shown in FIG. 3B) having an opening 73 that is threaded in an upper section (shown in FIG. 3B) for engaging the threaded shaft 48 of the threaded member 43 and that is nonthreaded in a lower section for engaging an upper portion of the elongate central member 36. Cylindrical portion 71 rotationally engages axis portion 62 of the first upper arm 60, and an inner annular section of the axis portion 62 rides on the upper annular rim of the cylindrical portion 71. At a bottom section of opening 73, cylindrical portion 71 receives the upper end of elongate central member 36, which upper end will be pushed downwardly, but not out of cylindrical portion 71, when the knob 44 is turned clockwise.

Upper connection 40 further includes a second upper arm 72 having a female receptor 74 for receiving and engaging an outer end of upper lateral member 22. Lower jaw 68, axis portion 69 and second upper arm 72 are integral and one-piece with each other.

As shown in FIG. 2A, lower connection 42 includes a first lower arm 76 and a second lower arm 78. First lower arm 76 includes an axis portion or jaw 80 having a central sunken nonthrough receptor 82 for receiving a lower end of the central elongate member 36. Axis portion 80 includes a horizontally extending lower face or rim 84. First lower arm 76 further includes a female receptor portion 86 for receiving and engaging an end of lower lateral member 24.

Second lower arm 78 includes an axis portion or jaw 88 having a central receptor 90 (shown in FIG. 3C) for receiving and rotationally engaging the interior portion of the sunken nonthrough receptor 82. Axis portion 88 further includes a horizontally extending upper face or rim 92 for frictionally engaging horizontally extending lower face or rim 84 of the first lower arm 76. Central elongate member 36 is pushed downwardly by the end 49 of threaded shaft 48 and thus the bottom end of central elongate member 36 pushes downwardly upon the sunken portion 82 and upper jaw 80 as a whole, to thus bring lower rim 84 into frictional engagement with the upper rim 92 of lower jaw 88 such that the upper and lower connections 40 and 42 are tightened at the same time and are loosened at the same time. Second lower arm 78 further includes a female receptor portion 94 for receiving and engaging an end of lower lateral member 24.

In operation, the connector 12 tightens and loosens the upper and lower connections 40 and 42 at the same time. First, the knob 44 is turned counter-clockwise so as to draw the threaded shaft 48 partially out of the lower jaw 68. Such permits an upward release of the upper jaw 50 relative to lower jaw 68 and disengages jaws 50 and 68 from each other so as to permit rotation of the jaws 50 and 68 relative to each other. Such in turn permits swinging of the first upper arm 60 relative to the lower jaw 68 and its integrally connected upper arm 72. Since the knob 44 has been turned so as to raise the threaded shaft 48, pressure is relieved upon the central elongate shaft 36 and thus pressure is relieved upon jaw or axis portion 80 relative to jaw or axis portion 88. This permits the first lower arm 76 to swing relatively freely of second lower arm 78. With the first and second upper arms 60 and 72 swinging relative to each other and with the first and second lower arms 76 and 78 swinging relative to each other, adjacent barrier sections 14 and 20 can be swung to generally any angle relative to each other from generally zero degrees to generally 270 degrees. Then, to fix the barrier sections 14 and 20 in place relative to each other after the desired form of the safety barrier 10 as a whole is attained, knob 44 is turned clockwise so push jaw 50 vertically downward relative to upper arm 60 such that section 66 of upper arm 60 is fully engaged in slot 56 and so as to fully engage teeth 54 with teeth 70 of jaw 68, whereupon the upper arms 60 and 72 are fixed relative to each other. Such a turning of knob 44 at the same time pushes, via shaft end 49 pushing upon the upper end of central elongate member 36, toothless jaws 80 and 88 closed such that rims 84 and 92 frictionally engage each other, thereby fixing in place adjacent barrier sections 14 relative to each other.

It should be noted that a tightened configuration is where the knob 44 is turned fully clockwise so as to fully engage the upper jaws 50 and 68 and so as to fully engage the lower jaws 80 and 88. In this tightened configuration, barrier sections 14 and 20 are swingable relative to each other only under great pressure and which pressure may destroy the integrity of the connector 12. It should be noted that a loosened configuration includes a position where knob 44 has been turned away from the fully clockwise position to a point where upper jaws 50 and 68 somewhat disengage and where lower jaws 80 and 88 somewhat disengage. In this position, barrier sections 14 and 20 can be swung relative to each other and the connector 12 may make a clicking noise, which clicking noise is provided by teeth 54 and teeth 70 running over each other, which teeth 54 and 70 are still under pressure from the knob 44. This position may be desirable where minor adjustments to barrier section angles are to be made. It should be noted that a loosened configuration further includes a position where knob 44 has been turned counter-clockwise to a point where the only pressure upon teeth 70 is the free weight of upper jaw 50. In this position, shaft 48 is still engaged in opening 73 such that knob 44 need not be taken fully off connector 12 such that knob 44 will not be lost. In this position, the barrier sections 14 and 20 are freely swingable relative to each other with minimal, if any, clicking noise from teeth 54 and 70.

Gate 16 and the gated barrier section 20 are shown in FIGS. 1, 3A, 3B and 3C. Gated barrier section 20 includes a U-shaped frame 95 that includes a lower lateral member 96, a first longitudinal or upright member 98, and a second longitudinal or upright member 100. Since the U-shaped frame 95 bears the brunt of the gate 16 closing and opening, lower lateral member 96 and longitudinal members 98 and 100 are somewhat wider and deeper and stronger than counterpart members 22, 24, 26 in barrier sections 14.

Gate 16 is formed within the U-shaped frame 95 and includes an upper lateral member 102 and a lower lateral member 104. Extending to and between the lateral members 102, 104 are a set of longitudinal upright members 106. One end upright member 106A is pivotally engaged to lower lateral member 96 at a lower end and is pivotally engaged at an upper end to angle member 108, which also engages upright member 98. The other end upright member 106B slidingly confronts upright member 100 and includes a metal tab 107 welded to its bottom end on one side. Tab 107 extends downwardly beyond lower lateral member 104 to confront a side of lower lateral member 96. Tab 107 thus prevents gate 16 from swinging fully through barrier section 20. Tab 107 thus provides a gate 16 that swings generally for 180 degrees. A latch 110 is pivotally affixed to lateral member 102 at or near the junction of upright member 106B and lateral member 102. Latch 110 can be biased, such as with a coil spring, to remain in an unengaged angled position relative to upright member 100. However latch 100 is preferably unbiased in any direction. A slide 112 is slidingly engaged to upper lateral member 102. Slide 112 is biased to a closed and engaged position where slide 112 engages one end of the latch 110 so as to keep the other end of latch 110 engaged to upright member 100. When the slide 112 is slid manually away from latch 110, latch 110 can be pivoted to an unengaged position relative to upright member 100, thereby permitting the gate 16 to be opened. When manually released, slide 112 slides automatically under the pressure of a spring such as a coil spring, to the closed and engaged position with latch 110. Latch 110 engages upright member 100 via a pair of side latch portions 111 that extend to and over portions of the front and back sides of upright member 100.

Figure 3A:
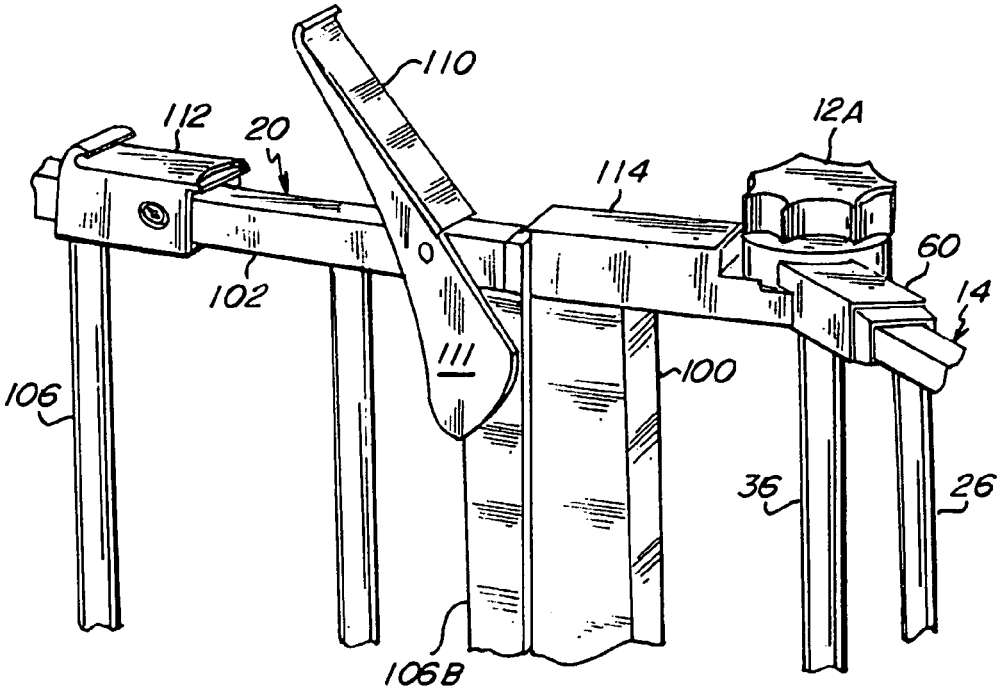
FIG. 3A is a perspective, detail view of a portion of the gate and adjoining connector of FIG. 1.
Figure 3B:
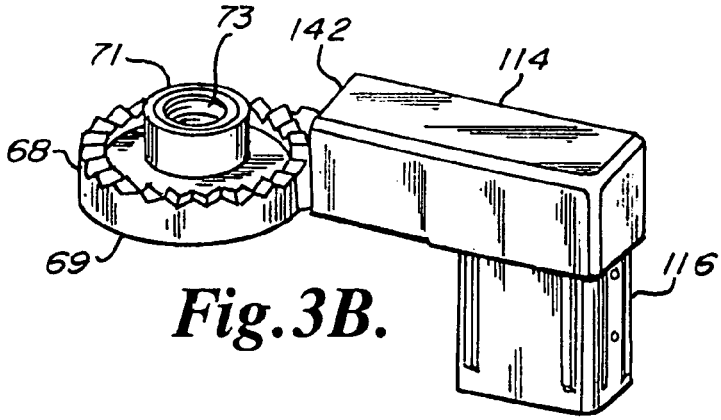
FIG. 3B is a perspective, detail view of a portion of the upper connection for a connector utilized adjacent to the gate of FIG. 3A.
Figure 3C:
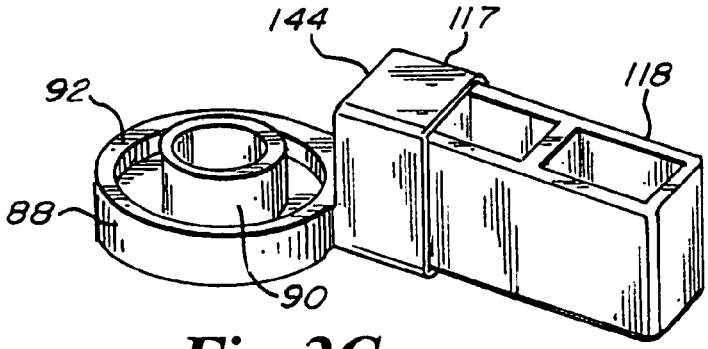
FIG. 3C is a perspective, detail view of a portion of a lower connection for a connector utilized adjacent to the gate of FIG. 3A.

As shown in FIGS. 1, 3A and 3B, connectors 12A on either side of the gated barrier section 20 are modified to provide for the U-shaped frame 95. As shown in FIGS. 3A and 3B, in place of the female receptor 74 at the upper connection 40, connector 12A includes a short lateral member 114. Projecting downwardly from an end of lateral member 114 is a male connection 116 that is inserted into the upright member 100 on one end of the U-shaped frame 95 and that is inserted into the upright member 98 on the other end of the U-shaped frame 95. In place of second lower arm 78 at the lower connection 42, connector 12A includes a short lateral member 117 having engaged laterally thereto a male connection 118 for being inserted into one of the open female ends of the lower lateral member 96.

Figure 5A:
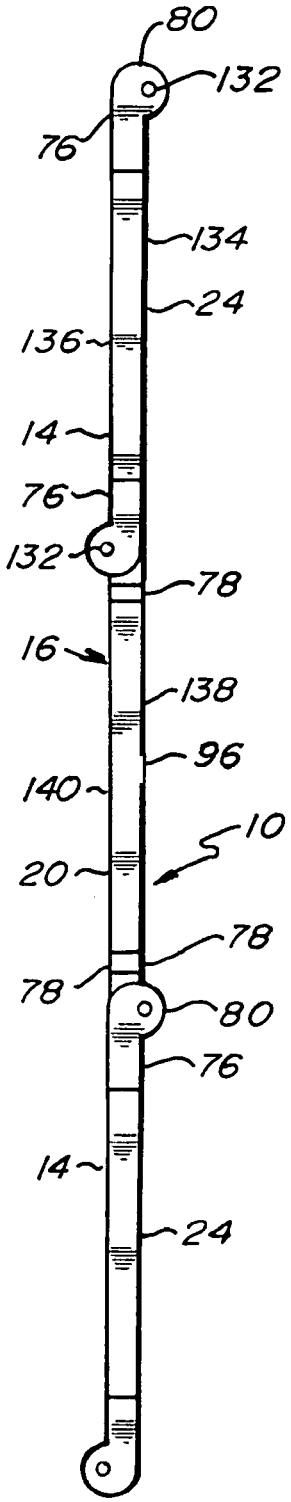
FIG. 5A is a diagrammatic view of barrier sections of the gated safety barrier of FIG. 1 showing the barrier sections arranged in a straight linear form.
Figure 5B:
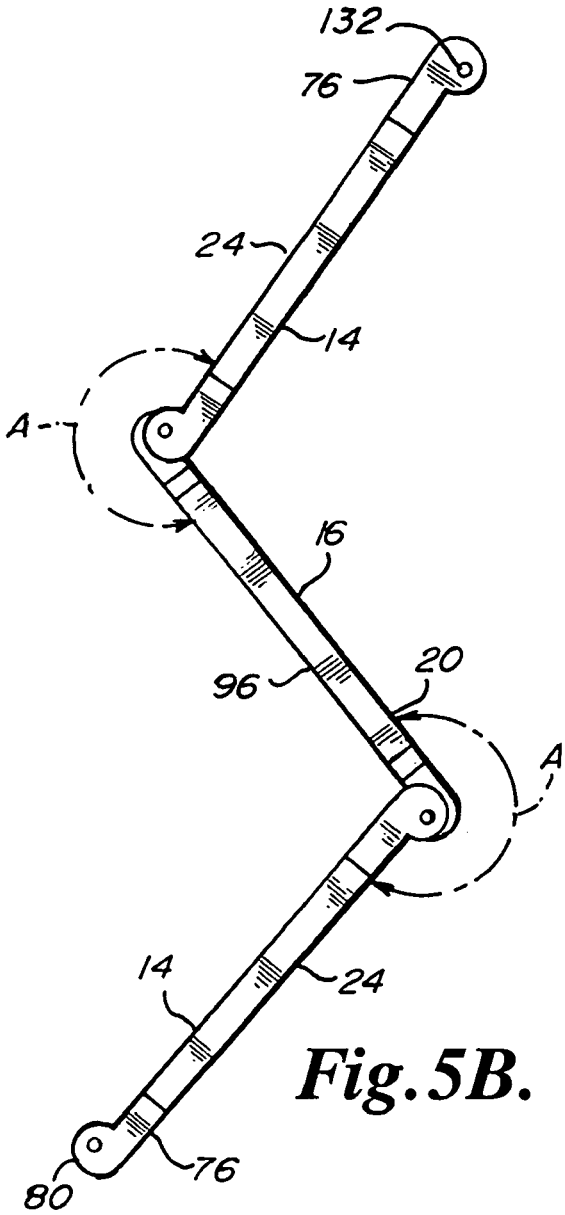
FIG. 5B is a diagrammatic view of barrier sections of the gated safety barrier of FIG. 1 showing the barrier sections arranged in a zig-zag type form.

The lower arms 76 and 78 are swingable relative to each other to any angle between about zero degrees and about 270 degrees, as shown by reference character A in FIG. 5B. Likewise, the upper arms 60 and 72 are swingable relative to each other to any angle between about zero degrees and about 270 degrees. The upper arms 60 and 72 include respective sides 126 that confront each other when the upper arms 60 and 72 are swung fully relative to each other in one direction, as shown in FIG. 2A. The lower arms 76 and 78 include respective sides 128 that confront each other when the lower arms 76 and 78 are swung fully relative to each other in one direction, as shown in FIG. 2A.

Figure 5C:
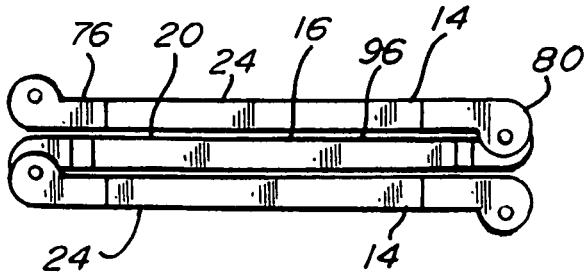
FIG. 5C is a diagrammatic view of barrier sections of the gated safety barrier of FIG. 1 showing the barrier sections folded down to a compact form.

As shown in FIG. 5A, the gated safety barrier 10 can take a straight linear form. Here, barrier sections 14 are aligned with gated barrier section 20. As shown in FIG. 5B, barrier sections can take a zig-zag form, with the barrier sections 14 and 20 fully rotated to 270 degrees relative to each other. As shown in FIG. 5C, barrier sections 14 and 20 take a compact form, with barrier sections 14 running parallel to each other, and with each of the barrier sections 14 running parallel to barrier section 20.

FIGS. 5A, 5B and 5C also show a planar feature of vertically running axis 132 of connector 12 (or connector 12A). Axis 132 is the axis on which lies the connector 12, the elongate central member 36, the sunken receptacle or cavity 82 for the lower end of the elongate central member 36, the receptor 90, knob 44, threaded shaft 48, end 49, axial opening 58, axis portion 62, axial portion 69, opening 73, and cylindrical portion 71. Axis 132 lies in a plane defined by one face 134 of barrier section 14 or in a plane defined by the other face 136 of the barrier section 14. Axis 132 also lies in a plane defined by face 138 of gated barrier section 20 or in a plane defined by the other face 140 of gated barrier section 20. Such planar relationships hold true regardless of whether the gated safety barrier 10 is in the straight linear, zig-zag or compact forms shown in FIGS. 5A, 5B and 5C. Such planar relationships also hold true regardless of any other form that the gated safety barrier 10 may take. Such faces of the barrier sections can be defined as the outer sides of the upper and lower lateral members 22 and 24 of barrier section 14 and the outer sides of the lower lateral member 96 in combination with the outer sides of upright members 98 and 100 of the gated barrier section 20.

It should be noted that face or stop 142 of short lateral member 114 and face or stop 144 of short lateral member 117 act to stop swinging of arms 60 and 76 at 270 degrees. In the other direction, upper and lower arms of barrier sections 14 and 20 make contact with each other to arrest the swinging at zero degrees.

It should be noted that barrier sections 14 and 20 fold or swing in an alternate fashion. This alternate or staggering type of arrangement is provided for by staggering or alternating the barrier section face with which axis 312 is aligned. In other words, adjacent axis 132 are aligned with opposing barrier section faces. In still other words, if a first axis 132 is aligned with face 134, then an adjacent second axis 132 is aligned with face 136, then an adjacent third axis is aligned with face 132 (if the adjacent barrier section is an ungated barrier section 14) or with face 138 (if the adjacent barrier section is the gated barrier section 20).

It should be noted that the gated safety barrier 10 preferably includes a gate or door 16. However, the gated barrier section 20 may be excluded such that a barrier consisting of only barrier sections 14 may be formed. The number of barrier sections 14 and 20 in one gated safety barrier 10 is unlimited.

It should be noted that the gated barrier section 20 may be engaged to the base 18 if desired.

It should be noted that a barrier may be set up with 1) two bases 18 and one barrier section (either barrier section 14 or gated barrier section 20), 2) with zero, one or two bases 18 with one or more barrier sections 14, and 3) with zero, one or two bases 18 with one or more barrier sections 14 and one or more gated barrier sections 20.

It should be noted that reference to a lateral element or a lateral direction in this case generally means a generally horizontally running element or direction when the gated safety barrier 10 is in an operating position. It should be noted that reference to a longitudinal element or a longitudinal direction means a generally vertically running element or direction when the gated safety barrier 10 is in an operating position.

It should be noted that the definition of jaw does not necessarily include teeth. Further, a pair of jaws do not necessarily swing relative to each other like the jaws of a mouth. For example, a vise such as in a woodworking shop has jaws that move to and away from each other on an axis without swinging.

Each of the barrier sections 14 and 20 is generally about two feet in length and about two and one-half feet in height.

It should be noted that the gated safety barrier 10 is readily disassembled. While an individual barrier section 14 or 20 itself is preferably not disassembled and preferably does not include any reasonable capacity for such, connector 12 is readily removable from barrier section 14 or 20 and connector 12 itself can be disassembled. For example, knob 44 is turned counter-clockwise and removed from jaws 50 and 68. Then upper jaw 50 is lifted off the axis portion 62 of upper arm 60. Then upper arms 60 and 72 can be slid off of the lateral members of the barrier sections. Then the elongate central member 36 can be lifted off jaw 80 and out of sunken receptor 80. Then lower arms 76 and 78 can be slid off the lateral members of the barrier sections.

It should be noted that preferably only partial disassembly is made. That is, the knob 44 is turned counter-clockwise and taken off. Then the central elongate member 36 can be slid upwards, out of sunken receptor 82 and upwards, through and out of openings 73, 67, and 58. Arms 60, 72, 76 and 78 remain engaged to their respective barrier sections. Using this partial disassembly step, one or more barrier sections 14 and 20 can be inserted into the gated safety barrier 10 to increase the length of the barrier 10 or one or more barrier sections 14 and 20 can be taken out of the gated barrier 10 to shorten the length of the barrier 10. To reconnect barrier sections, the procedure is simply reversed. The gated safety barrier 10 can also be shipped in this partially disassembled configuration. Further using this partially disassembled configuration, a barrier section can be engaged to base 18, with the elongate central connector 36 being inserted vertically through the hinges 34 such that the hinge member 35 need not be removed from T-shaped member 32.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A gated safety barrier having a customizable layout, comprising:

a) a set of barrier sections;

b) a gate engaged in one of the barrier sections, with the gate being openable and closeable;

c) a connector engaged between adjacent barrier sections and comprising:

i) an upper connection having a pair of upper arms that are swingable relative to each other, with each of the upper arms engaging one of the adjacent barrier sections, with the upper connection further having a pair of upper jaws, with each of the upper jaws engaged to one of the upper arms such that a closing of the upper jaws prevent the upper arms from swinging relative to each other and such that an opening of the upper jaws permit the upper arms to swing relative to each other;

ii) a lower connection having a pair of lower arms that are swingable relative to each other, with each of the lower arms engaging one of the adjacent barrier sections, with the lower connection further having a pair of lower jaws, with each of the lower jaws engaged to one of the lower arms such that a closing of the lower jaws prevent the lower arms from swinging relative to each other and such that an opening of the lower jaws permit the lower arms to swing relative to each other; and iii) an elongate central member engaged between the upper and lower connections and controlling an opening and closing of at least one pair of the upper and lower pairs of jaws; and d) a base, with the base being adaptable for engagement to a wall, with the base being engagable to said connector, and with the base having first and second portions that are laterally adjustable relative to each other such that a barrier section, engaged to said connector that is engaged to said base, is adjustable laterally relative to the wall in a lateral direction to and away from the wall such that the barrier section is adjustable to and away from the wall in the horizontal direction, wherein said first portion of the base includes a hinge member engageable to said connector, with said second portion of the base being a T-shaped member, wherein one of the first and second base portions includes a slot extending in said lateral direction, wherein the other of the first and second base portions includes a pin connector hole to engage the first and second portions of the base to each other with a pin connector and to provide for said first and second base portions being laterally adjustable in said lateral direction relative to each other.

2. A gated safety barrier having a customizable layout, comprising:

a) a set of barrier sections;

b) a gate engaged in one of the barrier sections, with the gate being openable and closeable; and c) at least a pair of first and second connectors, with said first connector engaged between adjacent barrier sections and having tightened and loosened configurations, with said second connector engaged between adjacent barrier sections and having tightened and loosened configurations, with said first connector being structured to provide a relative swinging between said adjacent barrier sections when the first connector is in the loosened configuration, with said second connector being structured to provide a relative swinging between said adjacent barrier sections when the second connector is in the loosened configuration, with the first connector being structured to fix in place said adjacent barrier sections relative to each other when the first connector is in the tightened configuration, with the second connector being structured to fix in place said adjacent barrier sections relative to each other when the second connector is in the tightened configuration, with each of said connectors comprising:

i) an upper connection having a first upper arm for engaging a first barrier section and a second upper arm for engaging a second barrier section;

ii) a lower connection having a first lower arm for engaging the first barrier section and a second lower arm for engaging the second barrier section;

iii) an elongate central member between the upper and lower connections and being engaged to each of the upper and lower connections; and iv) a vertically running axis about which adjacent barrier sections are relatively swingable;

d) wherein each of the barrier sections includes a first face defining a first plane and a second face defining a second plane, with the vertically running axis of said first connector being aligned in said first plane, and with the vertically running axis of said second connector being aligned in said second plane whereby said barrier sections are foldable relative to each other into a compact orientation;

e) wherein said first connector further comprises a pair of upper jaws, with one of the upper jaws engaging said first upper arm and with the other of the upper jaws engaging said second upper arm;

f) wherein said second connector further comprises a pair of lower jaws, with one of the lower jaws engaging said first lower arm and with the other of the lower jaws engaging said second lower arm;

g) wherein said first connector yet further comprises a knob comprising a threaded shaft that engages one of the upper jaws such that when the knob is turned the upper jaws are tightened relative to each other to fix the upper arms relative to each other, and with said threaded shaft comprising a distal end; and h) wherein said elongate central member further comprises an upper end and a bottom end, with said distal end of said knob bringing downward pressure upon said upper end of said elongate central member, with said bottom end of said elongate central member bringing downward pressure upon one of the lower jaws to in turn bring pressure upon the other of the lower jaws to engage the lower jaws relative to each other to engage the lower arms relative to each other.

3. The gated safety barrier according to claim 2, wherein each of the first and second upper arms of one of the first and second connectors is swingable relative to each other when said one connector is in the loosened configuration, with the first and second upper arms of one of the first and second connectors being fixed relative to each other when said one connector is in the tightened configuration, and wherein each of the first and second lower arms of one of the first and second connectors is swingable relative to each other when said one connector is in the loosened configuration, with the first and second lower arms of one of the first and second connectors being fixed relative to each other when said one connector is in the tightened configuration.

4. The gated safety barrier according to claim 2, wherein each of the connectors is structured such that adjacent barrier sections can be disposed between about zero and about 270 degrees relative to each other.

5. The gated safety barrier according to claim 2, wherein each of the connectors is structured such that adjacent barrier sections can be disposed at relatively small angle increments relative to each other over a range from about zero degrees to about 270 degrees.

6. The gated safety barrier according to claim 2, wherein each of the connectors is structured such that adjacent barrier sections can be disposed at angle increments relative to each other over a range from about zero degrees to about 270 degrees, where each of said angle increments is between about 5 degrees and about 20 degrees.

* * * * *